US005083537A

United States Patent [19]

Onofrio et al.

[11] Patent Number: 5,083,537

[45] Date of Patent: Jan. 28, 1992

[54] COMPOSITE INTERNAL COMBUSTION ENGINE HOUSING

[75] Inventors: David A. Onofrio, Riverview; William C. Hallandal, Southfield, both of Mich.

[73] Assignee: Ford Motor Company, Dearborn, Mich.

[21] Appl. No.: 628,021

[22] Filed: Dec. 17, 1990

[51] Int. Cl.[5] ..... F02F 7/00

[52] U.S. Cl. ..... 123/175 R; 123/41.74; 123/195 C

[58] Field of Search ..... 123/41.74, 41.81, 41.84, 123/195 R, 195 C; 29/888.01, 888.06, 888.061; 264/257, 274, 275

[56] References Cited

U.S. PATENT DOCUMENTS

| | | | |
|---|---|---|---|
| 4,446,827 | 5/1984 | Kubozuka | 123/195 C |
| 4,644,911 | 2/1987 | Hidaka et al. | 123/195 C |
| 4,726,334 | 2/1988 | Holtzberg et al. | 123/195 R |
| 4,848,292 | 7/1989 | Holtzberg | 123/193 Ch |
| 4,930,470 | 6/1990 | Kabat et al. | 123/41.74 |

*Primary Examiner*—Noah P. Kamen

*Attorney, Agent, or Firm*—Joseph F. Malleck; Roger L. May

[57] ABSTRACT

A cylinder block for an internal combustion engine, comprising: (a) a siamesed cylinder sleeve unit (steel or metal matrix composite) having an annular tongue flange spaced above but adjacent the bottom of the unit; and (b) a plastic jacket (phenolic, vinyl ester, or epoxy) spaced from but surrounding the sleeve unit and having the tongue flange molded integrally with the jacket, the sleeve unit and jacket being adapted for closure by a head having a wall to mate with the planar top of the sleeve and jacket; and (c) sealant deposited at interfacing surfaces of the sleeve unit and jacket which are integraly molded, the sleeve being constituted of a metal-based material having a thermal expansion characteristic differing from the plastic jacket by no greater than 25%.

16 Claims, 10 Drawing Sheets

COMPOSITE INTERNAL COMBUSTION ENGINE HOUSING

BACKGROUND OF THE INVENTION

1. Technical Field

This invention relates to the design of internal combustion engine housings including its constituent components such as a cylinder block, crankcase, and oil pan, and more particularly to the technology of reducing the weight of such components without affecting their operating integrity and doing so at a reduced manufacturing cost.

2. Discussion of the Prior Art

The possibility of making an internal combustion engine out of Polymeric materials has been considered for some time but has been constrained mostly to speculation and research Prototypes A fiber-reinforced plastic engine housing would reduce vehicle fuel consumption directly through its weight reduction and indirectly through the weight reduction of associated components. Manufacturing costs would be reduced by minimizing the size and weight of metal components, increasing the number of units cast in each mold box, shortening the time to produce the component, increasing corrosion resistance, reduction of scrap, and by the reduction of subsequent external machining and finishing costs. The noise, vibration, and harshness (NVH) of the power unit would be decreased by the inherent sound insulation (noise damping) properties of fiber-reinforced materials. Additionally, time taken for the engine to warm up from a cold condition would be reduced because of the smaller metallic content of the engine and the reduction of heat loss.

In spite of these potential advantages, the use of fiber-reinforced plastics or phenolics must take into consideration that a modern spark ignition engine operates in a very harsh environment. The engine materials are subjected to oil and water/ethylene glycol at temperatures up to 400° K., exhaust gases at mean temperatures up to 1100° K., and peak temperatures in the combustion chamber of 2400° K. while under conditions of high stress on the order of 200 MPa. Under these conditions, an engine is expected to also have a long life with minimal wear and be able to withstand excessive under-bonnet temperatures during "hot soak".

The first initial use of plastics in engines has been with respect to rocker covers, thermostat housings, and timing chain or belt covers; the immediate vehicle environment for these types of components is much less harsh and therefore excellent creep properties are not essential for these components. When attention is focused on the engine block and cylinder head assembly, the immediate environment is much more demanding and challenging because the structure must sustain the combustion pressure and convert it to mechanical torque at the crankshaft. The reaction of this torque is transmitted through the base block structure to both the transmission housing and engine mount and ultimately to the vehicle structure.

Due to the necessity for withstanding torque and pressure, the next sequential prior art concept envisioned was for use of metallic insert cylinder bore sleeves accompanied by plastic as the outer sleeve or framework for the block; in all cases, the plastic and metallic members are bolted together to withstand torque and pressure (see U.S. Pat. Nos. 4,644,911; 4,726,334; and 4,446,827). The high compression loads that are constantly present at the liner and main bearing clamping points, resulting from bolting, will lead to creep of the composite material and eventual failure.

What is needed is a new approach to making a composite internal combustion engine housing that simplifies securement of the composite material without critically affecting its integrity and structural rigidity.

SUMMARY OF THE INVENTION

The invention is, in a first aspect, a cylinder block for an internal combustion engine, comprising: (a) a siamesed cylinder sleeve unit constituted of metal or hybrid metal matrix composite and having a radially outwardly extending annular tongue flange spaced above but adjacent the bottom of said unit; and (b) a jacket surrounding but spaced from said sleeve unit except at about said unit flange where said jacket and unit are integrally molded together, said jacket being constituted of molded fiber-reinforced plastic substantially matched to the thermal expansion characteristic of said sleeve unit.

Preferably, said sleeves are constructed of one of an aluminum matrix composite or steel; said sealant is preferably an anerobic epoxy type adhesive; said plastic for said jacket is a plastic selected from the thermosetting resin group consisting of phenolics, vinyl esters, and epoxies. These plastics have good heat and creep resistance with chopped glass fibers or equivalent and can be molded by injection or compression molding. The plastic can be reinforced with finely chopped strands of glass fiber used either in a phenolic resin matrix and randomly distributed, or with resin in a continuous fiber random mat or glass fiber network made by swirling the fiber as it is deposited in a random manner within the plane of the mat. The block preferably has a deep integral skirt extending from the bottom of the cylinder block, or, alternatively, the skirt may be eliminated and a platform flange used to terminate the bottom of the jacket thereby requiring an independent upper crankcase member of plastic.

The cylinder block invention is characterized by one or more of the following features: (i) a molded outer wall around the liner sleeve unit, (ii) the thermal expansion characteristic of the sleeve unit is matched to the material of the jacket, (iii) the use of interlocking flanges to promote an inter-molded union between the sleeve unit and jacket therebetween, and (iv) sealant at the interfacing juncture between the unit and jacket.

Another aspect of this invention is a composite block-crankcase assembly for an internal combustion engine, comprising: (a) a siamesed cylinder sleeve unit (i) constituted of ferrous, carbon fiber or aluminum metal matrix composite, and (ii) having a radially outwardly extending annular tongue flange spaced from but adjacent the bottom of the unit; (b) a jacket (i) surrounding but spaced from the sleeve unit except at about the tongue flange where the jacket and unit are integrally molded together, (ii) having a sealant on the interfacing surfaces of said jacket and unit that are integrally molded, (iii) having a deep depending annular skirt strengthened by a plurality of spaced transverse walls adapted to serve as an upper crankcase member, (iv) constituted of molded phenolic plastic; and (c) a lower oil pan member constituted of molded plastic and adapted for being secured to the skirt of the jacket, the jacket and oil pan having bushing fittings and molded-in-place oil galleries extending commonly therebetween.

BRIEF DESCRIPTION OF THE DRAWINGS

The novel features of the invention are set forth with particularity in the appended claims. The invention itself, however, both as to its organization and method of operation, together with further objects and advantages thereof, may best be understood by reference to the following description taken in conjunction with the accompanying drawings, in which:

DETAILED DESCRIPTION AND BEST MODE

Figure 1:
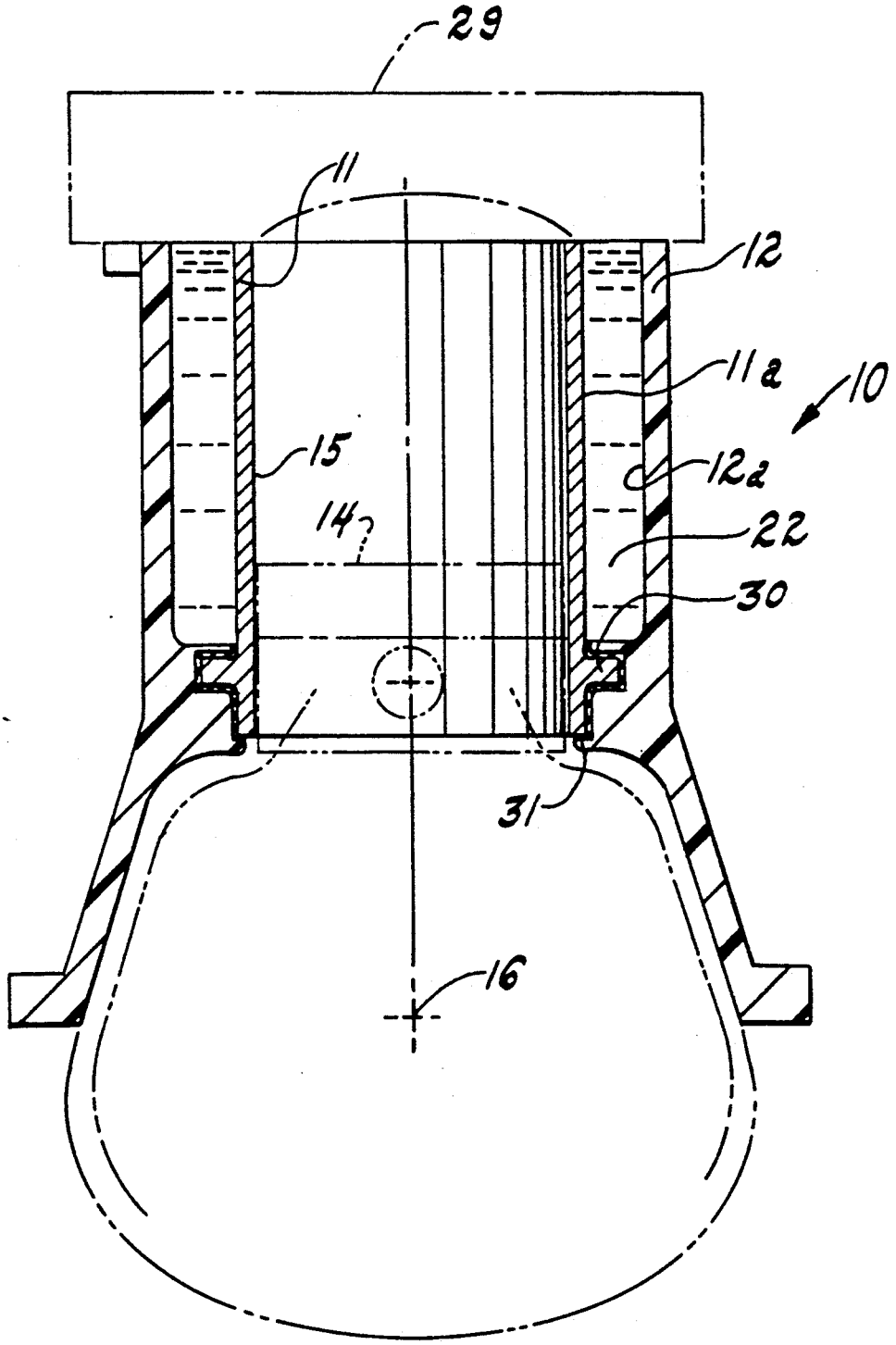
FIG. 1 is an elevational sectional view of an internal combustion engine block embodying the principles of this invention, the section being taken along line 1—1 of FIG. 4.
Figure 4:
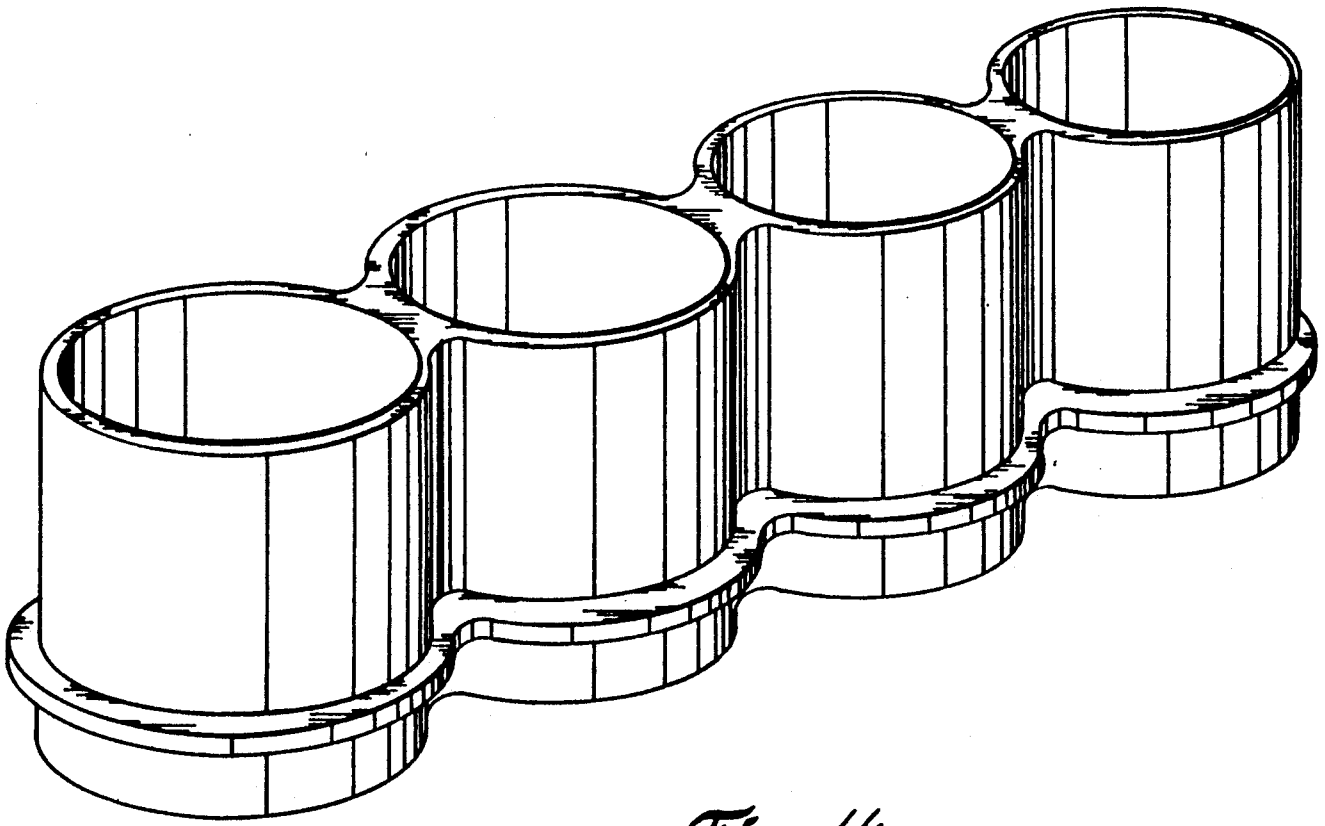
FIG. 4 is a perspective view of the sleeve unit of the structure of FIG. 1.
Figure 5:
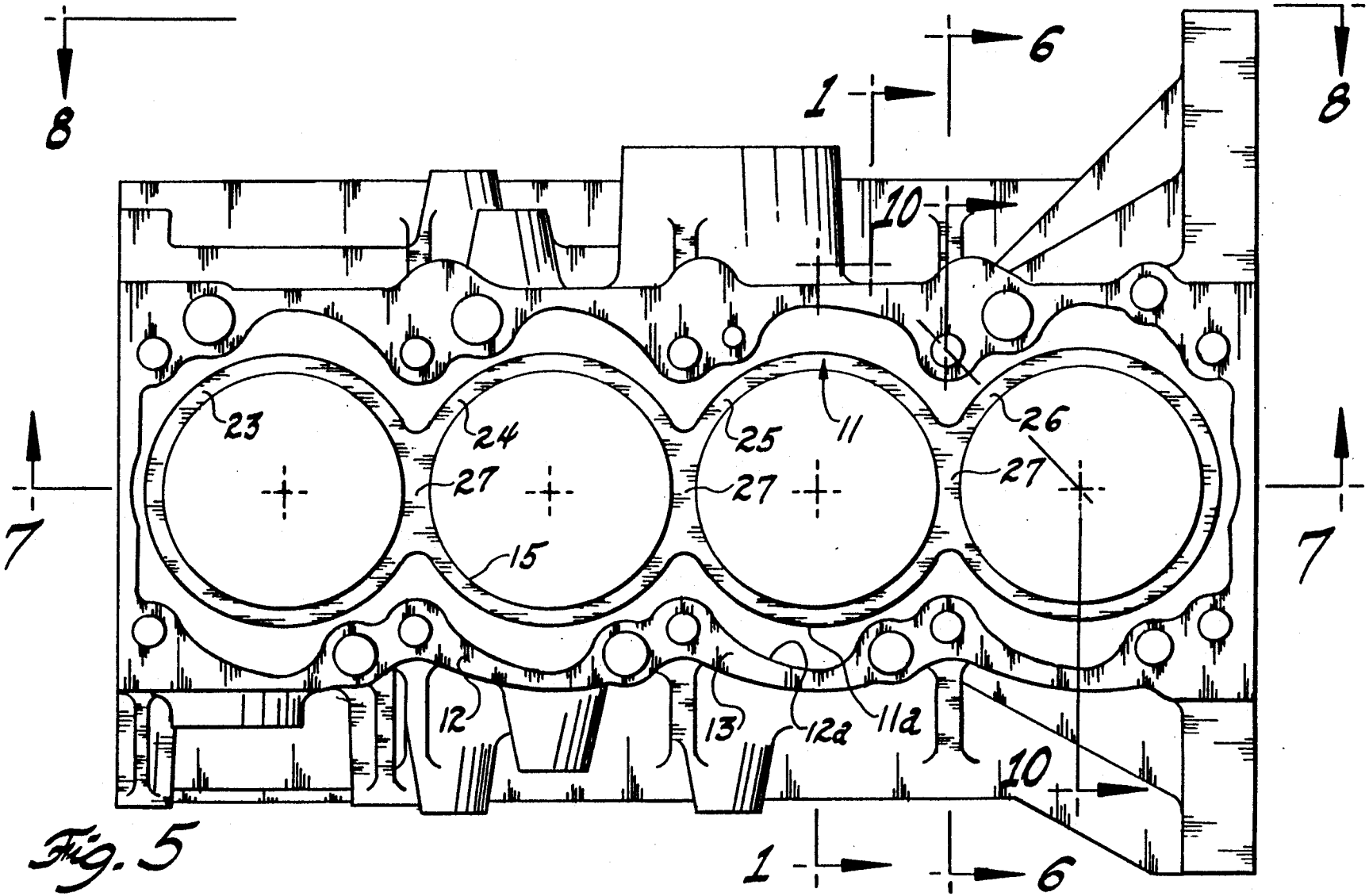
FIG. 5 is a plan view of the internal combustion engine block of FIG. 1.
Figure 6:
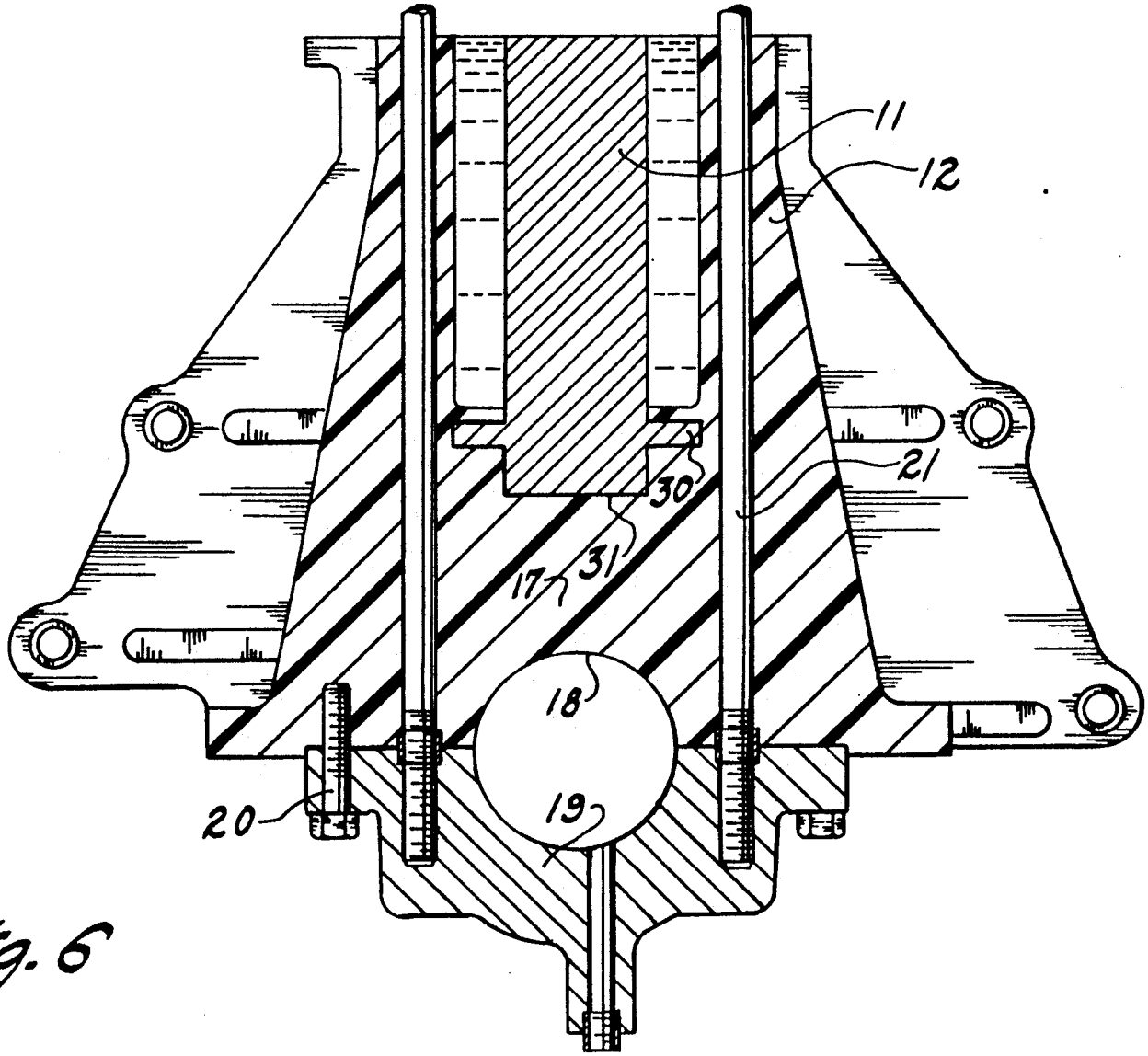
FIGS. 6, 7 and 8 are respectively sectional or elevational views taken substantially along lines 6—6, 7—7, and 8—8 of FIG. 5.
Figure 7:
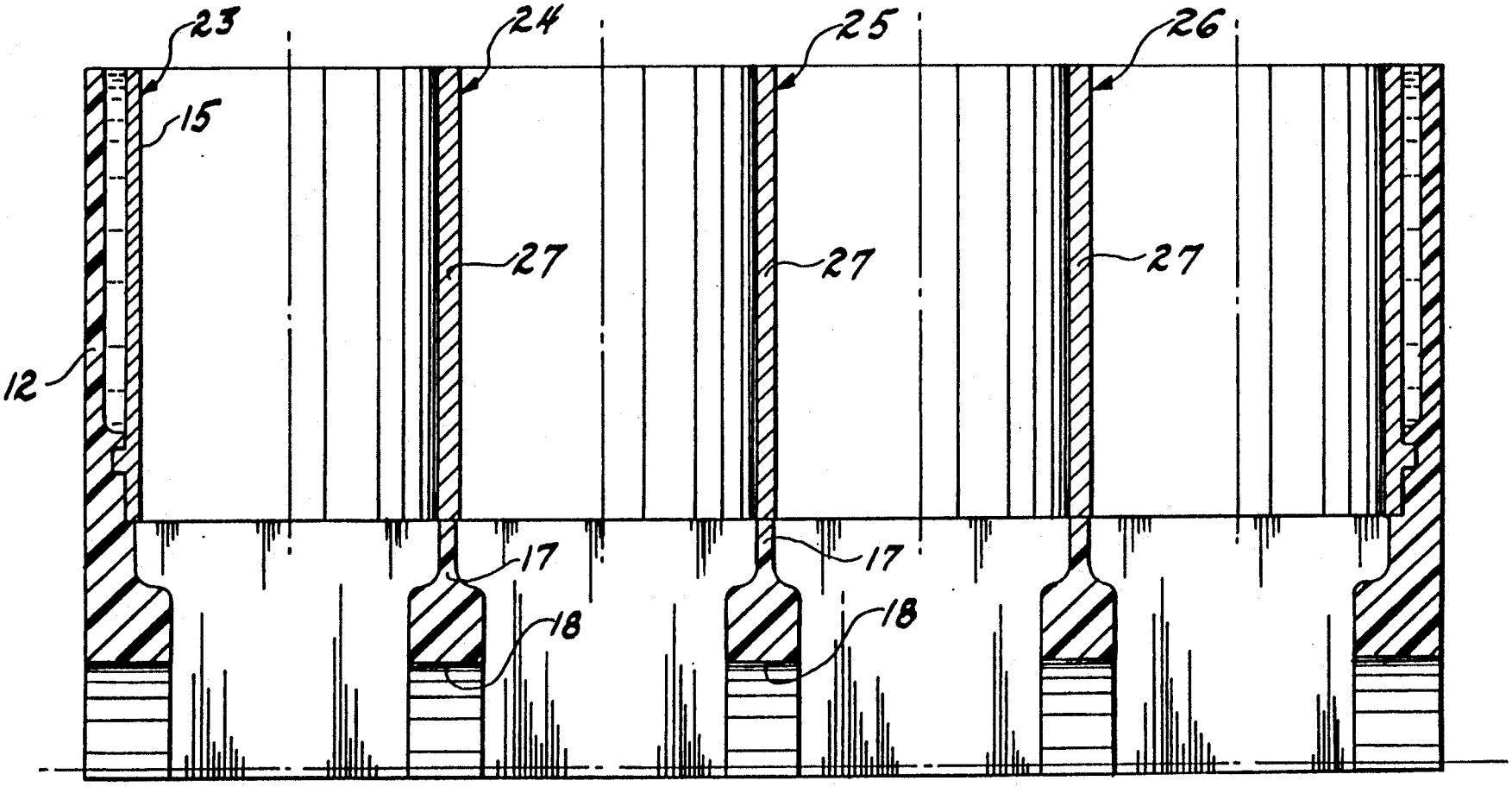
Figure 8:
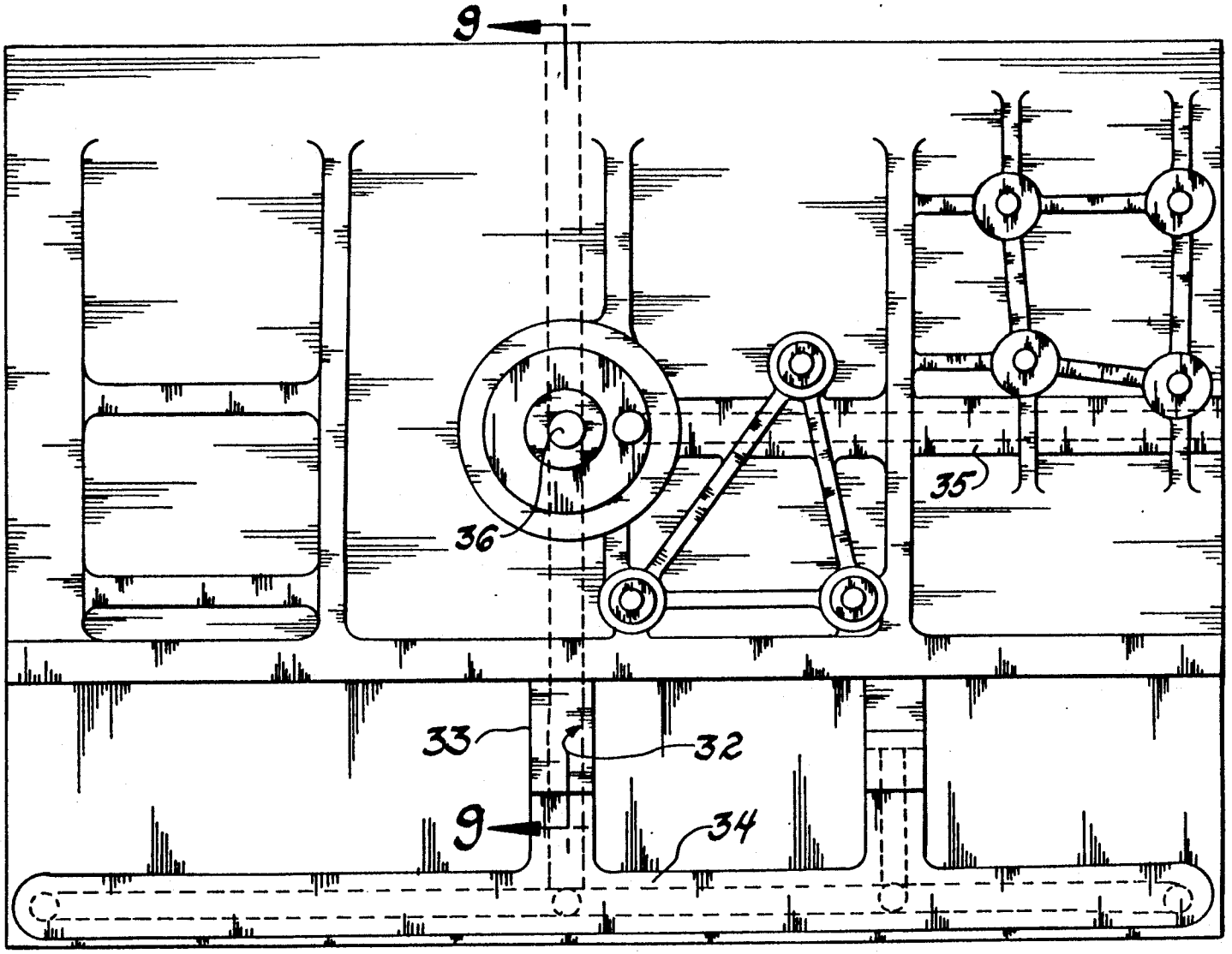

As shown in FIGS. 1 and 4, the block assembly 10 of this invention essentially comprises a sleeve unit 11, a deep skirted jacket 12, and sealant 31. The piston 14, not part of this assembly, would normally reciprocate within the cylinder wall 15 of unit 11 to drive a crankshaft rotatable about an axis 16. As shown in FIGS. 5 and 6, the assembly has the jacket defined with transverse bulkhead walls 17 to act as upper main bearing members at 18; a lower main bearing cap 19 is attached by fasteners 20 to wall 17. Tie rods 21 may extend through the jacket 12 to secure an engine head 29 to the lower main bearing cap 19.

Figure 2:
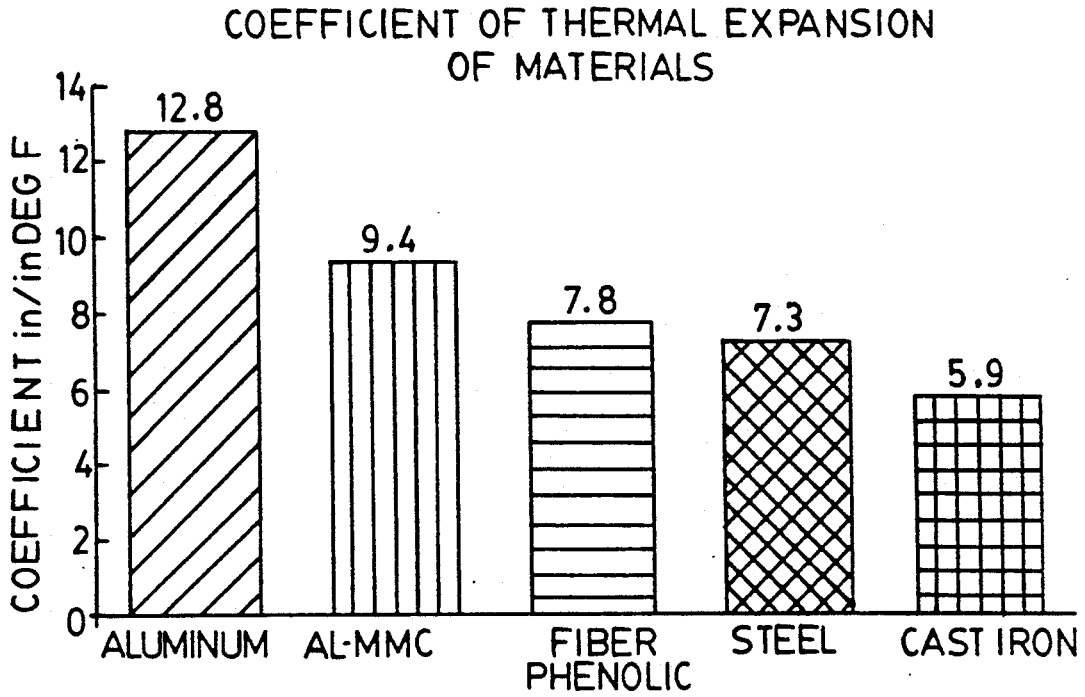
FIG. 2 is a bar graph illustrating the variation in the coefficient of thermal expansion for candidate materials useful for an engine block.
Figure 3:
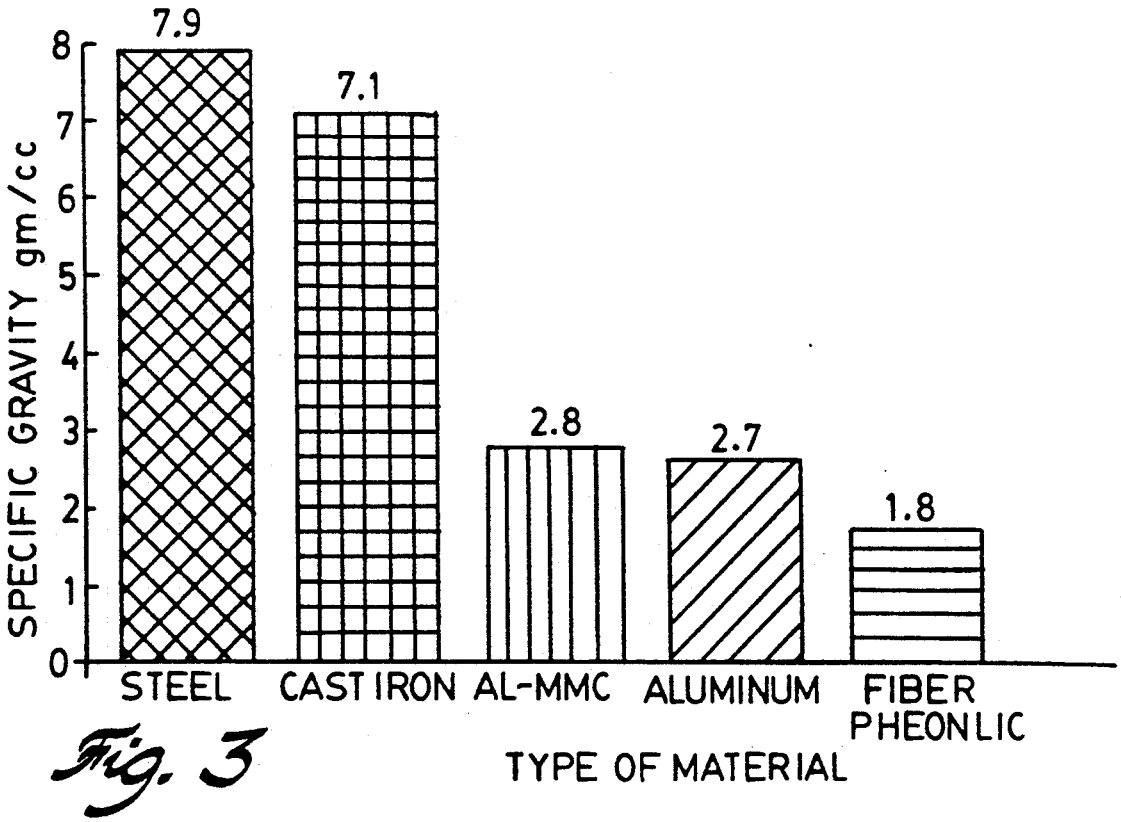
FIG. 3 is a bar graph illustrating the variation in specific gravity for the same materials as in FIG. 2 but including titanium.

In the scheme of fabrication of the assembly 10, the sleeve unit 11 is finish-machined first and used as an implant in the subsequent fabrication of the jacket 12. As shown in FIG. 4, the sleeve unit is configured with a plurality of cylinders 23, 24, 25, and 26, each for receiving a Piston and cooperating in part to form a combustion chamber. The sleeve unit has a radially outwardly extending annular tongue flange 30 spaced from but adjacent the bottom 31 of the unit. The cylinders are siamesed at 27 between each of the adjacent cylinders to promote high temperature and loaded dimensional stability. The combination of thermal and mechanical stresses imposed on the cylinder sleeve unit is severe. The cylinder sleeve unit serves to: guide the pistons through their strokes, seal the combustion gases in conjunction with the piston rings, retain the combustion gases with the piston rings, retain the combustion forces generated, transfer heat to the coolant, and resist the preload applied by the head bolts or nuts required to seal the combustion chamber and withstand the combustion forces. Knowing the severity of such requirements, especially the thermal conditions, guides the designer away from expensive composite materials with dry liners. However, this invention has found that wet liner cylinders can be fabricated from material which is one of steel or aluminum metal matrix composite. Aluminum has a coefficient of thermal expansion by itself of about 12.8, but when formed as a metal matrix composite, it has a coefficient of thermal expansion of about 9.4 (see FIG. 2); steel has a coefficient of thermal expansion of 7.3. As shown in FIG. 3, aluminum metal matrix composites have a significantly low specific gravity of about 2.8; steel, on the other hand, has a specific gravity of about 7.9.

The water jacket 12 is fabricated of "plastic" defined herein to mean a thermosetting resin of phenolic, vinyl ester, or epoxy. The jacket phenolic or epoxy resin is shaped to define a water coolant chamber 22 between the inner surface **12*a* of the jacket and the outer surface 11*a*** of the sleeve unit. The water jacket serves a number of structural functions in the engine block which include: retaining the coolant around the cylinder liners or sleeves, locates the upper portion of the cylinder liner, seals the coolant at water pump, head, and upper block, mounts the water pump, provides attachment or anchoring for a number of adjacent parts such as the transmission, accessory brackets, etc., incorporates oil and feed return passages to the cylinder head, provides coolant passages or ports to the cylinder head, reacts to the compressive preloads applied by the torqueing of the cylinder head bolts (or nuts), and provides torsional and bending stiffness to the block assembly.

The materials necessary for the jacket of this invention preferably includes a fiber-reinforced thermosetting plastic of the phenolic, unsaturated vinyl-ester, or epoxy resin type. The coefficient of thermal expansion for these materials can be modified by fiber-reinforcement orientation within a wide range of 1–18. For purposes of this invention, the plastic and its orientation is selected to have a coefficient to substantially match that of the sleeve unit, that is, the coefficient of thermal expansion should not differ between the materials by more than 25%. The phenolics have excellent heat and creep resistance and can be molded by injection or compression molding processes; phenolics are desirable because of their relatively low material cost compared to other thermosetting materials.

A detailed method for fabricating the block comprises the following: (1) casting the cylinder sleeve unit in a semirough form; (2) machining the sleeve unit to a finished size and dimension; (3) fabricating jacket mold dies using the cylinder sleeve as the "skeleton" structure and pattern for such die and utilizing the cylinder bore centers and perpendicularity of the bores as the basis for the mold die dimensions to thereby ensure that the jacket and sleeve unit are in proper orientation and accurately positioned relative to the centerline of the crankshaft; (4) installing locating dowel holes or pins in the mold for accurately positioning the sleeve unit into the mold die; (5) inserting rods, pins, and preshaped mold inserts for shaping the water jackets, water inlet, oil passages, and other contours in the jacket; (6) applying an anerobic sealant to the tongue flange of the sleeve unit to ensure water jacket to crankcase integrity and prevention of leaks; (7) molding in place threaded inserts for attaching accessories and mold-in-place bushings in the rear face of the block for mounting a transmission; (8) premixing the plastic matrix with a chopped fiberglass reinforcement or other suitable reinforcement material; (9) injecting or compressing the reinforced plastic into the mold dies under high pressure and allowing the material to cure at elevated temperatures, e.g., 350° F.; (10) machining the molded jacket and integral sleeve unit along the crankshaft axis, and machining the main bearing journals and bearing caps as an assembly with the block; (11) machining any remaining surfaces, holes and passages that cannot be molded a specified (critical) dimension.

The resulting structure of this invention, in essential aspects, is (a) a cylinder block for an internal combustion engine which has a preformed siamesed cylinder sleeve unit having an annular tongue flange spaced from the bottom of the unit; and (b) a plastic jacket spaced laterally from but surrounding the sleeve unit but molded integrally about the tongue flange of the sleeve, the sleeve unit and jacket being adapted for closure by a head having a wall to mate with the planar top of the sleeve and jacket. The jacket is desirably constituted of phenolic plastic and the sleeve unit is constituted of a metal-based material having a thermal expansion characteristic differing from the phenolic plastic by no greater than 25%. A sealant is deposited between the interfacing surfaces that are integrally molded. Such sealant is preferably selected as an anerobic epoxy adhesive such as Loctite L0559C.

Figure 9:
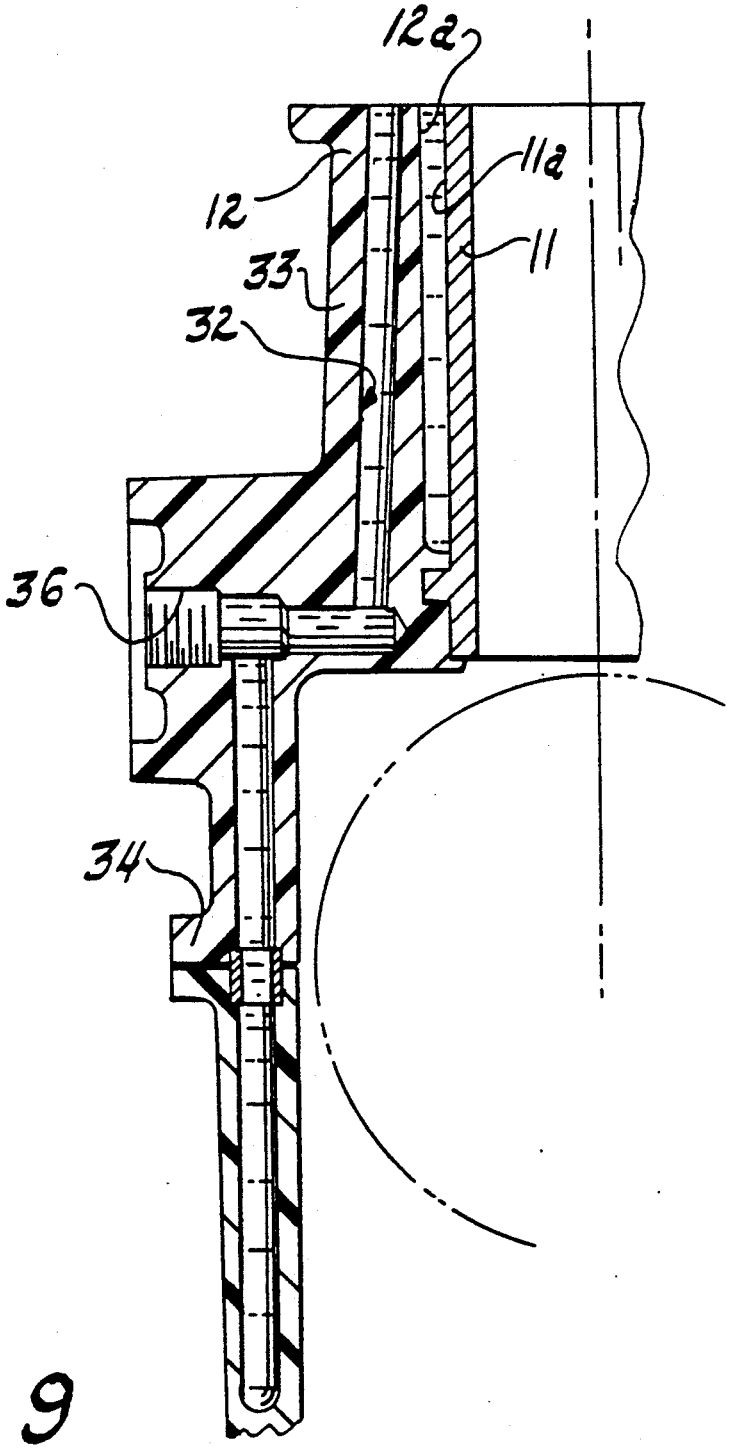
FIG. 9 is a sectional view taken substantially along line 9—9 of FIG. 8.
Figure 10:
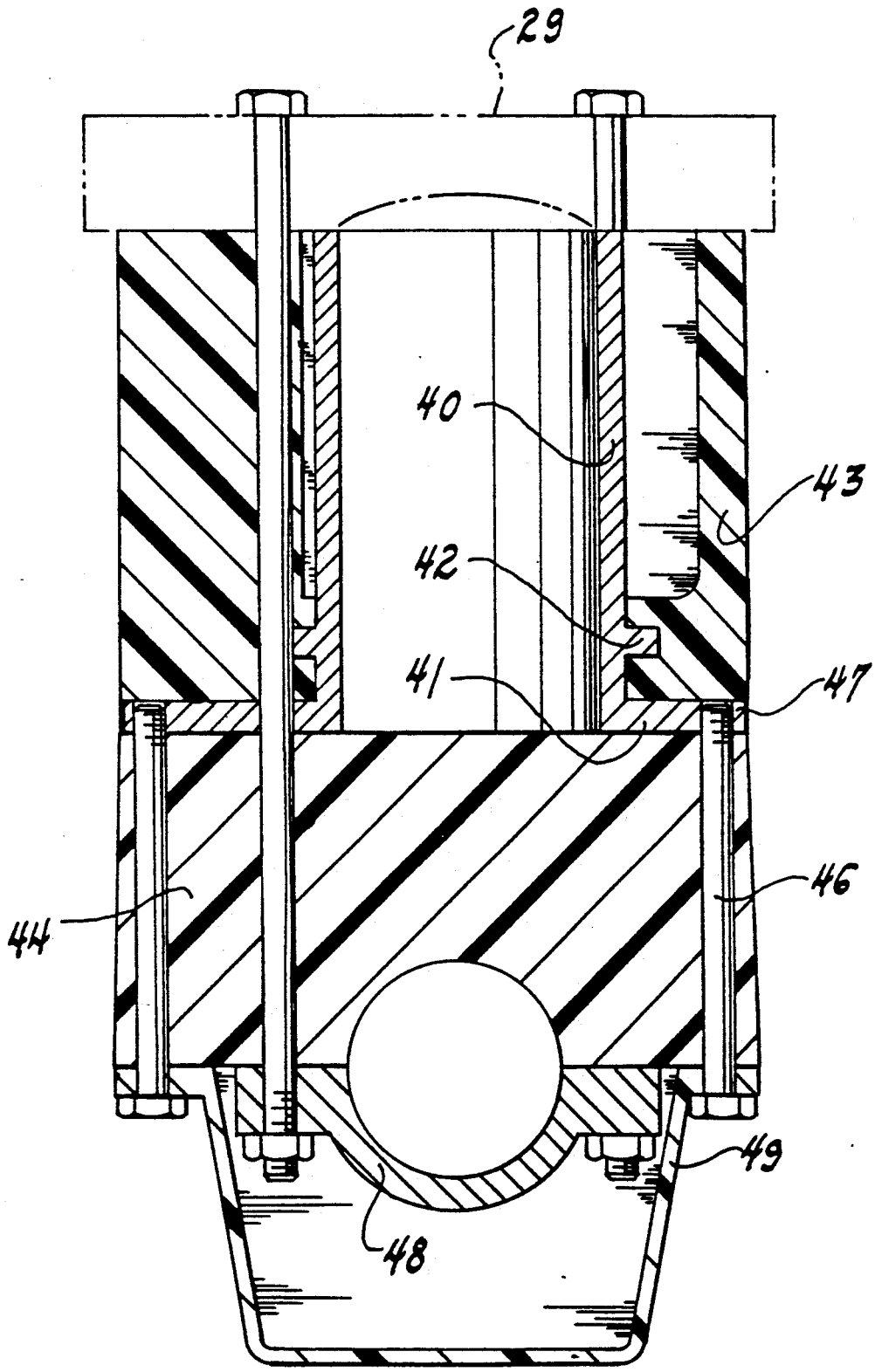
FIG. 10 is a further alternative arrangement of a housing embodying features of this invention.
Figure 11:
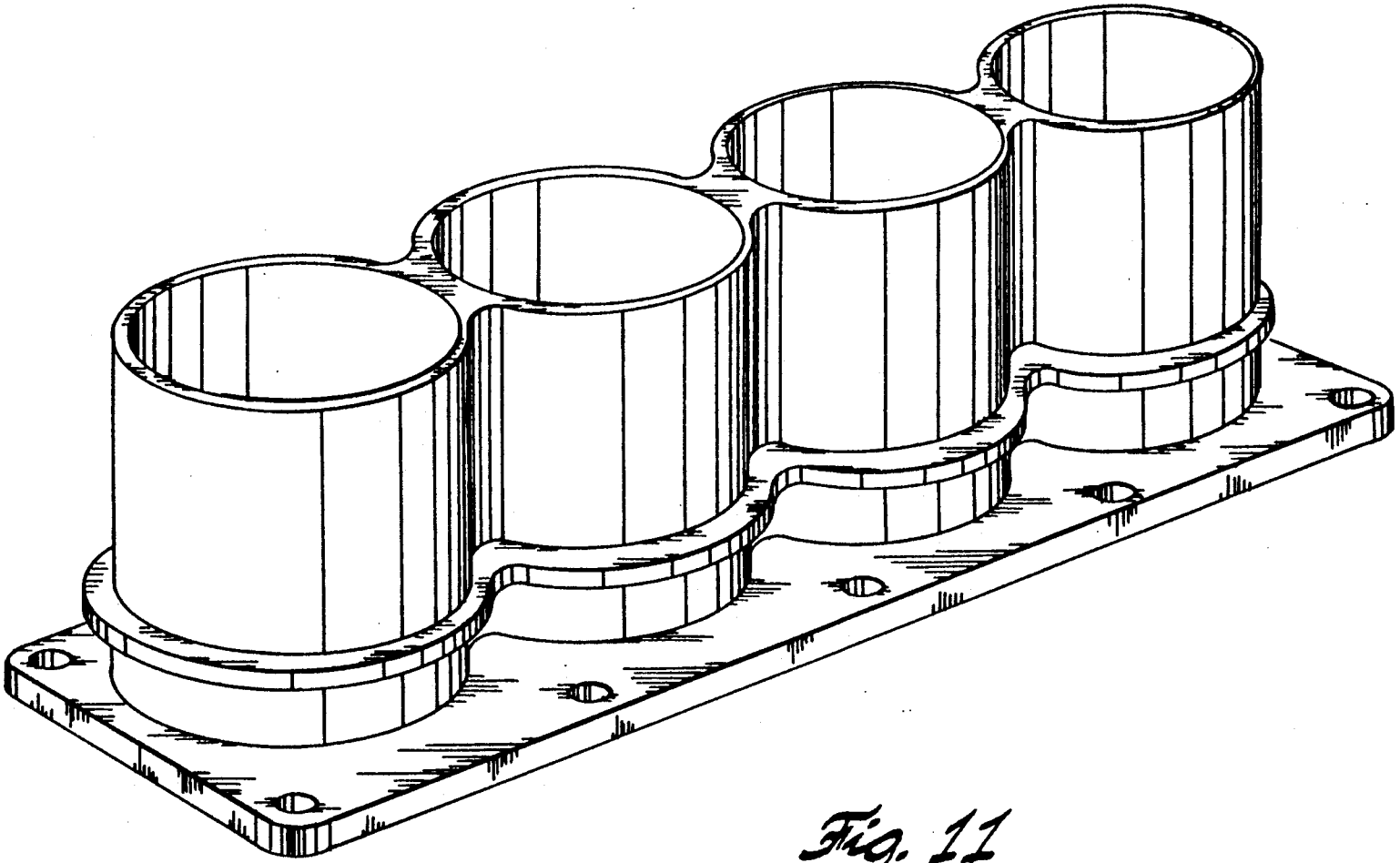
FIG. 11 is a perspective view of the sleeve unit of the structure of FIG. 10.

As shown in FIG. 9, a more comprehensive assembly of this invention is illustrated with a composite block-crankcase assembly having: (a) a siamesed cylinder sleeve unit 40 (i) constituted of a material selected from ferrous, carbon fiber, or aluminum metal matrix composite, and (ii) having a radially outwardly extending platform flange 41 and a radially outwardly extending tongue flange 42 spaced above but adjacent the platform flange; (b) a jacket 43 laterally surrounding but spaced from the sleeve unit except at about the unit flanges 41 and 42 where the jacket and unit are integrally molded together; (c) a plastic crankcase 44 having spaced transverse walls 45 adapted to serve as an upper crankshaft bearing member and having means 46 for securement to the sleeve unit at 47; (d) a lower crankcase member 48 constituted of metal or molded plastic and adapted for being secured to the crankcase member 44, the jacket and lower crankcase member having bushing fittings and molded-in-place oil galleries 32 extending commonly therebetween; and (e) a plastic oil pan 49. Securement is by the bolts 50 extending from the oil pan 49 lip, through the crankcase member 44, through the jacket 12 and platform flange 41 of the sleeve unit, and received by fasteners on the opposite side of the head 29.

While particular embodiments of the invention have been illustrated and described, it will be obvious to those skilled in the art that various changes and modifications may be made without departing from the invention, and it is intended to cover in the appended claims all such modifications and equivalents as fall within the true spirit and scope of this invention.

We claim:

1. A cylinder block for an internal combustion engine, comprising:

(a) a siamesed cylinder sleeve unit comprising metal and having a radially outwardly extending annular tongue flange spaced from but adjacent the bottom of said unit; and (b) a jacket surrounding but spaced from said sleeve unit except at about said unit flange where said jacket and unit are integrally molded together, said jacket being constituted of molded fiber-reinforced plastic substantially matched to the thermal expansion characteristic of said sleeve unit.

2. The block as in claim 1, in which said sleeve unit metal is selected from the group consisting of steel and a metal matrix composite, and said jacket plastic is selected from the group consisting of phenolic, epoxy, and vinyl esters.

3. The block as in claim 1, in which said jacket plastic and sleeve unit material each have a thermal expansion characteristic differing by no greater than 25%.

4. The block as in claim 1, in which said jacket has a depending annular skirt strengthened by a plurality of spaced transverse walls adapted to also serve as an upper crankcase member, and a sealant deposited between said jacket and sleeve unit at integral molding locations.

5. A composite block-crankcase assembly for an internal combustion engine, comprising:

(a) a siamesed cylinder sleeve unit (i) constituted of a matrix composite carrying iron, carbon fiber, or aluminum, and (ii) having a radially outwardly extending annular tongue flange spaced from but adjacent the bottom of said unit;

(b) a jacket (i) surrounding but spaced from said sleeve unit except at about said unit tongue flange where said jacket and unit are integrally molded together, (ii) having a sealant on the interfacing surfaces of said jacket and unit that are integrally molded, (iii) having a deep depending annular skirt strengthened by a plurality of spaced transverse walls adapted to also serve as an upper crankcase member, (iv) constituted of molded phenolic plastic; and (c) a lower oil pan member constituted of molded plastic and adapted for being secured to the skirt of said jacket, said jacket and oil pan member having bushing fittings and molded-in-place oil galleries extending commonly therebetween.

6. The assembly as in claim 5, which further comprises a head, said head being secured to said assembly by bolts extending from the lower crankcase member into the jacket interface and through the jacket to the head.

7. The assembly as in claim 5, in which said assembly further comprises a plastic oil pan secured to the bottom of said upper crankcase member.

8. A method of making a cylinder block for an internal combustion engine, comprising:

(a) fabricating a siamesed cylinder sleeve unit of a material selected from the group consisting of steel and aluminum matrix composite, said unit being defined with a radially outwardly extending annular tongue flange spaced from but adjacent the bottom of the unit;

(b) implanting said unit in a mold for injection or compression molding of a plastic jacket; and (c) molding said plastic jacket to surround but be spaced from said unit except at about said tongue flange where said jacket and unit are integrally molded together.

9. The method as in claim 8, in which sealant is deposited on and about said tongue flange prior to step (c).

10. The method as in claim 8, in which said molding of step (c) includes reinforcement with the use of preinserted chopped glass fibers arranged from a continuous fiber random mat or fibers deposited in a random manner in a plastic matrix.

11. The method as in claim 8, in which said sleeve unit is machined to finish size and dimension between steps (a) and (b).

12. The method as in claim 8, in which in step (c) the bore centers of said sleeve unit is a reference for aligning all other surfaces of the jacket, said sleeve unit being locked in position within said mold by dowels or pins.

13. The method as in claim 8, in which in step (c) said plastic is injected or compressed at high pressure and cured at a temperature of about 350° F.

14. A cylinder block for an internal combustion engine, comprising:

(a) a siamesed cylinder sleeve unit having a platform flange and an annular tongue flange spaced above said platform flange;

(b) a plastic jacket spaced from but surrounding said sleeve unit and having a base molded integrally with said tongue flange and platform flange of said sleeve unit, said sleeve unit and jacket being adapted for closure by a head having a wall to mate with the planar top of said sleeve unit and jacket; and (c) sealant deposited at surface locations on said sleeve unit and jacket which are integrally molded, said jacket being constituted of phenolic plastic and said sleeve being constituted of a metal-based material having a thermal expansion characteristic differing from said phenolic by no greater than 25%.

15. The block as in claim 14, in which the jacket is characterized by molded-in-place passages, oil galleries, fasteners, and inserts for attaching accessories.

16. The block as in claim 14, in which said sealant is anerobic.

* * * * *